United States Patent [19]

Kubo et al.

[11] 4,261,119

[45] Apr. 14, 1981

[54] METHOD FOR DIGGING AND TRANSPORTING MATERIAL

[75] Inventors: Masaaki Kubo, Musashino; Yasutaka Onodera, Kawaguchi; Hiroshi Kawaguchi, Tokyo; Masaharu Sibata, Kawaguchi, all of Japan

[73] Assignee: Mitsubishi Mining & Cement Co., Ltd., Tokyo, Japan

[21] Appl. No.: 925,606

[22] Filed: Jul. 17, 1978

[30] Foreign Application Priority Data

Jul. 22, 1977 [JP] Japan ..... 52-87303

[51] Int. Cl.[3] ..... E21C 41/04; E02F 3/46

[52] U.S. Cl. ..... 37/195; 37/116; 37/DIG. 1; 37/DIG. 19; 299/10; 299/18; 212/161; 254/286

[58] Field of Search ..... 37/195, 115–117, 37/DIG. 1, DIG. 19; 299/10, 18; 254/178, 182, 183, 184, 185 R, 185 A, 185 B, 185 AB, 186 R; 212/39 R, 39 B; 364/300

[56] References Cited

U.S. PATENT DOCUMENTS

| | | | |
|---|---|---|---|
| 779,043 | 1/1905 | Hulett | 37/195 X |
| 1,048,014 | 12/1912 | Wertelewski | 37/DIG. 19 |
| 1,244,203 | 10/1917 | Hawkesworth | 37/195 X |
| 1,881,743 | 10/1932 | Lillard | 37/115 |
| 2,060,867 | 11/1936 | Hollerbach | 37/116 X |
| 2,214,026 | 9/1940 | Martinson | 37/116 |
| 3,517,841 | 6/1970 | Eaton | 37/116 X |
| 3,636,325 | 1/1972 | Chytil | 37/116 X |
| 3,909,961 | 10/1975 | Lamer et al. | 37/116 |
| 4,035,621 | 7/1977 | Kemp | 37/116 X |
| 4,103,972 | 8/1978 | Kochanowsky | 299/18 |
| 4,150,852 | 4/1979 | McCoy | 299/18 |
| 4,150,853 | 4/1979 | McCoy | 299/18 |

FOREIGN PATENT DOCUMENTS

| | | | |
|---|---|---|---|
| 17762 | 8/1968 | Australia | 37/195 |
| 50474 | 11/1895 | Canada | 37/115 |
| 1708582 | 2/1968 | Fed. Rep. of Germany | 37/DIG. 19 |
| 2364194 | 6/1975 | Fed. Rep. of Germany | 37/116 |
| 374421 | 4/1973 | U.S.S.R. | 37/DIG. 19 |
| 538100 | 4/1977 | U.S.S.R. | 37/116 |
| 197708 | 8/1977 | U.S.S.R. | 37/116 |

*Primary Examiner*—E. H. Eickholt
*Attorney, Agent, or Firm*—Paul J. Sutton

[57] ABSTRACT

In digging and hauling soil, rocks, minerals and the like by the use of a dragline the invention provides a novel combination of said dragline, a conveyor for hauling the materials dug, and a hopper disposed over and movable along the conveyor whereby material may be efficiently excavated and transported out of the working area.

7 Claims, 18 Drawing Figures

METHOD FOR DIGGING AND TRANSPORTING MATERIAL

BACKGROUND OF THE INVENTION

1. Field of the Invention

This invention relates to a method and apparatus for digging stones and rocks, soil and sand, minerals, and the like (as will hereinafter be called merely soil and rock for simplicity), and more particularly to a method of digging soil and rock by the use of a novel combination of a dragline with haulage or transport system such as conveyor means and hopper means, and to a novel transport apparatus for use in said method.

2. Prior Art

In recent years there has been a need for high-production and high efficiency excavation methods in large scale land creating works, foreshore reclamation works, surface coil mining works on coal seams having thick overburden, or the like. One conventional method of digging soil and rock in the open air was to effect excavation by a shovel loader and carrying away the excavated material by trucks. Another method was to effect excavation by a bucket wheel excavator and haul the excavated material on a belt conveyor. Any of these prior art methods has been unsatisfactory with respect to the high capacity and efficiency when they were applied to large-scale works. Both the shovel loader and the bucket wheel excavator were inherently limited in size of their shovel or bucket because of their structure, hence they had a limited capacity. In addition they were particularly unsuitable for handling large masses of soil and rock, so that many manhours were required for blasting operations to prevent such large masses from being produced or for boulder blasting operations when great lumps were produced. The aforesaid former method is undesirable especially in excavating places involving bumpy roads because trucks are subject to severe damages.

Digging by the use of a high capacity dragline is known in a vast amount of rock removing work on overlying strata (over burden) above a coal seam as in a strip coal mining. This method provides a very high efficiency and large capacity operation in that the overlying rock as dug by the dragline are dumped and piled directly on the gob or waste area without using any intermediate transport means. However, in mining multiple coal strata having more than two coal seams it may be impossible to carry out the mining operation on the second and lower coal seams when the total thickness of the overlying rock layers exceeds the capacity of a dragline. Practically, therefore, it has been heretofore a usual practice to mine only the first uppermost coal seam even in the case of a multiple coal strata, or at most to dig out the upper layer of rock overlying the first coal seam by a power shovel, haul the excavated material to another place by trucks and then use draglines to dig the overburden of the second coal seam.

Even in the case of a single coal stratum, if there is a large thickness of overburden, there will be a correspondingly increased quantity of waste produced, so that an increased proportion of the waste which has once been dumped at one place must be again transferred to another distant place, resulting in decreasing the efficiency in operation. Furthermore, the boom of a dragline must be swung through an arc of more than 90° up to approximately 180° in operation in order to dump the waste as far as possible, resulting in extending the time required per cycle of the bucket, hence a decreased efficiency. This is due to the dragline's characteristics that despite its great digging capacity the transporting distance is limited to the length of its boom or at most the order of 100 m.

Belt conveyors are known as a large capacity and high efficiency haulage means. Shiftable conveyors capable of lateral movements are particularly suitable for use at a mining area where mobility of the transport means is required. Mining operation is composed primarily of digging and transporting operations. In the past, however, there has been no mining process employed involving a combination of a dragline as described which is a large capacity and high efficiency excavator and a belt conveyor which is likewise a high capacity and high efficiency transporter. One of the reasons is attributed to the dragline's characteristics. That is, since the dragline swings its boom to move its vast bucket filled with the excavated soil and rock (as will hereinafter be referred to as excavated or dug material), the dragline is best suited to dump the excavated material while scattering it over some extent of area. But it has difficulties in dumping the excavated material onto a particular small target such as a hopper or the deck of a truck. If this is to be done, it would take much time to position the dragline itself such that the bucket may be brought to a position directly above the hopper. It would also take a lot of time to bring the bucket to a halt just above the hopper in each cyclic operation between scraping and dumping actions by the bucket, resulting in an extended cycle time of the bucket and a decrease in efficiency. The dragline could not thus exhibit its inherent special performance. Conversely, if the bucket were allowed to dump the material over a considerable extent of region, the hopper should be an enormous one in size enough to receive the moving bucket. Even though it were made possible to hold the bucket size down to a certain extent by spending much time in controlling the movement of the bucket as described above, the bucket would still be of a considerable size and should be capable of movement as the dragline is moved around. Such movable hoppers have not heretofore been proposed.

Another reason that the combination of the dragline and belt conveyor has not been used lies in the belt conveyor. Materials dug often contain big masses of rock or stone. While the dragline can scrape up such dig lumps by its vast bucket, ordinary hoppers or belt conveyors cannot accommodate or handle big lumps. For the foregoing reasons any mining system utilizing a combination of draglines and belt conveyors has not been conceived of in the past.

OBJECTS AND SUMMARY OF THE INVENTION

An object of the invention is to provide a novel method of excavating stones and rocks, earth and sand, minerals and the like by the use of a novel combination of the dragline and transport means, and transporting apparatus for use in carrying out the method.

Another object of the invention is to provide a method of excavating and carrying away stones and rocks, earth and sand, minerals, etc. in an efficient manner, and a transporting apparatus for use in practising the method.

According to one aspect of the invention, a method of digging and transporting soil and sand, rocks and stones, minerals or the like by the use of a dragline including a bucket means for digging and carrying said soil, rocks, minerals, or the like, a boom means suspending for swinging movement therewith, a bucket control means for controlling said bucket means, and a boom control means for controlling the swinging movement of said boom means is provided which method comprises the steps of:

(a) fixing a hopper means at a predetermined location straddling a conveyor means for transporting the material dug, said hopper means being shiftable along the conveyor means and adapted to receive the dug material as carried in the bucket means by said dragline and load the material onto the conveyor means;

(b) positioning said dragline at such a location that the dug material in the bucket means may be dumped from right above said hopper means;

(c) digging soil, rock, minerals, etc. and loading the material dug onto said hopper means by operating said bucket control means and boom control means at said location, and performing such digging and loading operations in a like manner with said boom means positioned at it various swing positions, as required;

(d) thereafter shifting said hopper means by a certain distance along said conveyor means and fixing it in place;

(e) carrying out the steps (b) and (c); and (f) repeating the steps (d) and (e), as required.

According to another aspect of the invention, an apparatus for transporting soil and sand, rocks and stones, minerals or the like dug by a dragline is provided which apparatus includes a hopper means straddling a conveyor means for transferring the material dug, said hopper means comprising a pair of opposed side walls extending parallel to the longitudinal axis of said conveyor means, the walls defining an upper opening for receiving the material dug and sloping downwardly inwardly toward the conveyor means to form therebetween a lower discharge opening through which the dug material is deposited onto the conveyor means; a pair of opposed end walls extending transversely to the length of the conveyor means; a sieve means extending across said upper opening for separating relatively large masses from said dug material; support means for supporting at least said side walls; and mobile means attached to said support means for making said hopper means movable along the conveyor means.

According to still another aspect of the invention a transporting apparatus of the type described is provided which further includes a dug material receiving means comprising a receiving plate inclined in a direction opposite the direction of inclination of said hopper means, a support means for supporting said receiving plate, and mobile means attached to said support means movable along said conveyor means, said receiving plate being disposed above said hopper means.

According to still another aspect of the invention a transporting apparatus of the type described is provided which further includes a second conveyor means positioned shiftably along said sieve means and arranged to receive and transport those large masses of the dug material separated by said sieve means, a crusher means positioned shiftably along said hopper means and arranged to receive the large masses from the second conveyor means and break them to fragments, and a third conveyor means positioned movably along said hopper means and arranged to carry said broken fragments from the crusher means back to said first conveyor means.

BRIEF DESCRIPTION OF THE DRAWINGS

These and other objects and advantages of the invention will become more apparent from the following detailed description taken with reference to the accompanying drawings in which.

PREFERRED EMBODIMENTS OF THE INVENTION

Figure 1:
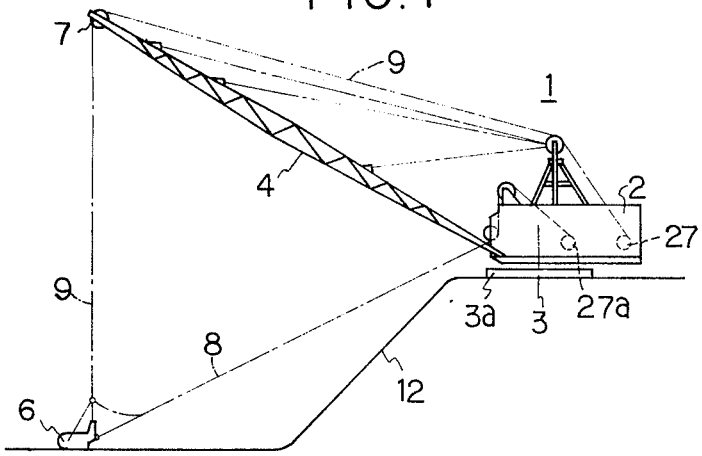
FIG. 1 is a side elevation of a walking dragline.

Referring to FIG. 1, a walking dragline 1 is shown comprising a revolving frame or main body 2 rotatably mounted on a radial base 3*a* for swinging movement about a central axis 3 along with a boom 4 mounted to the frame. Extending upward from a hoist rope drum 27 secured to the revolving frame is a hoist rope 9 which is trained around a head sheave 7 and then hangs down. Suspended from the forward end of the hoist rope is a bucket 6. A drag rope 8 extending from a drag rope drum 27*a* is also connected to the bucket 6. The walking dragline 1 is adapted to move around on its legs (not shown) which can be extended downward from the revolving frame 2 as required.

Figure 2:
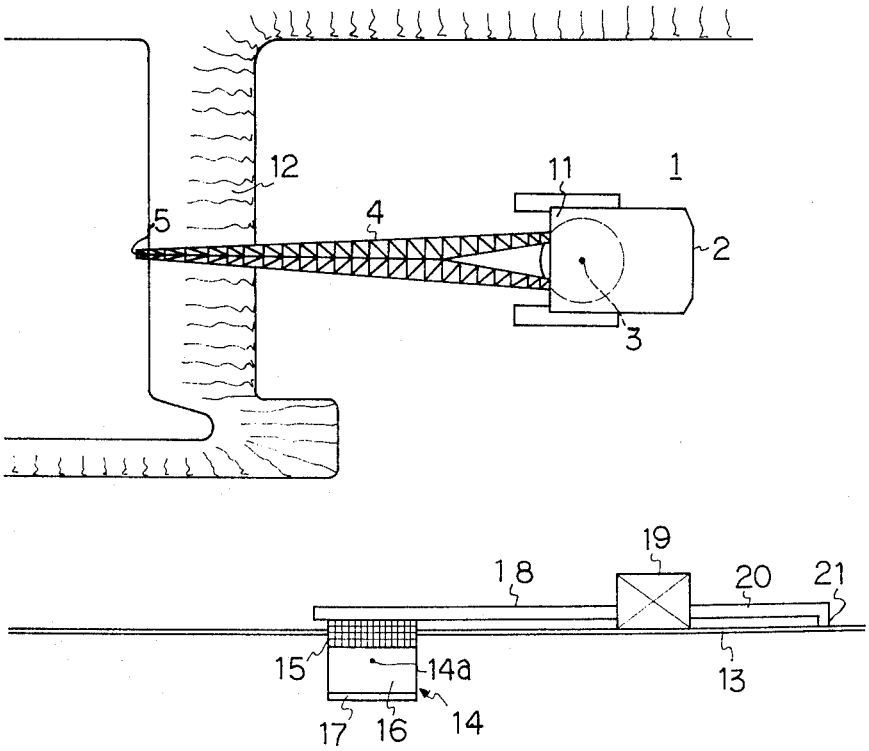
FIG. 2 is a top plan view illustrating an entire arrangement in a mining area to which the mining system according to the invention is applied.
Figure 3:
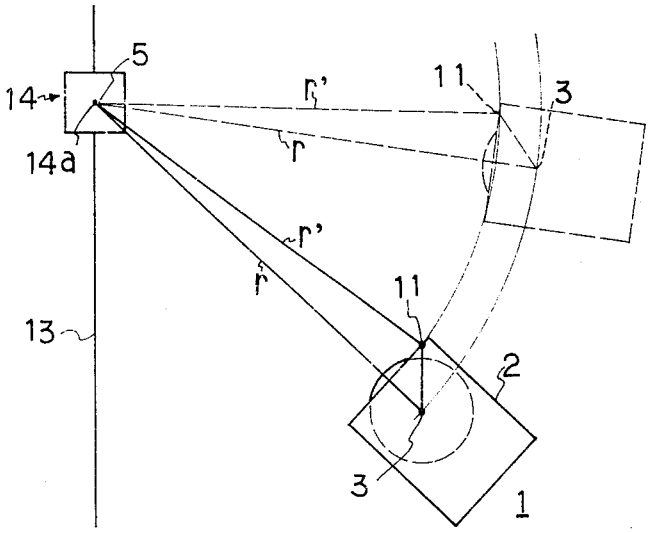
FIG. 3 is a diagrammatical view showing the positional relation between the hopper and walking dragline.

The excavating method according to this invention will first be described with reference to FIG. 2. If the bedrock to be excavated is excessively hard, the rock is beforehand broken to pieces by blasting. The excavated material is then scraped into the bucket 6 of the walking dragline 1, and the boom 4 is swung to move the bucket to a position over the hopper 14 for dumping the material into the hopper. The material is deposited through the hopper onto the belt conveyor 13 to be hauled thereby. This procedure is repeated until the dragline has finished digging the soil and rock within the reach of the dragline located at a fixed place, whereupon the dragline is moved to another location to continue with the excavating operation in a similar manner. The tilt angle of the boom can be adjusted, but as it requires much time, the boom is usually operated at a fixed dip angle for a particular work unit under the same working conditions. The range of movement of the dragline is limited to an arc with its center at the center 14*a* of the hopper 14 and with the length r of the boom as a radius, as shown in FIG. 3. The length of the boom is specifically defined as the distance between the forward end 5 of the boom and the central axis 3 of the revolving frame 2. On the other hand, the lateral width of one digging or cut zone is designed such that as long as the dragline moves around within said range of movement it can perform the excavation. When the excavation within the limits as defined by a particular fixed location of the hopper 14 is completed, the hopper is moved along the belt conveyor 13 by a distance equivalent to one dragging or scraping stroke of the dragline 1. Then, the dragline is moved to a position which accommodates the distances with respect to both the hopper 14 and the working face 12 and continues with the excavation in a similar manner. In this manner the excavation work is continued as the dragline 1 and hopper 14 are moved stepwise along the belt conveyor 13. When the dragline 1 thus reaches the end of the whole working area, the dragline, hopper 14 and belt conveyor 13 are all shifted laterally by a distance equal to one cutting width of the dragline to continue with the digging of the next adjacent zone to be dug of the area in a similar manner. In this case, the digging equipment may be returned to a location adjacent the starting point of the preceding working zone to effect the excavation in the same direction as with the preceding digging. Or alternatively, the excavation may be turned back from the terminal end of the preceding digging zone to proceed with the excavation of the next zone in a reverse direction.

In order to dump the excavated material precisely over the hopper, first of all the dragline must be located at a proper position, that is, on the aforesaid arc with the radius r about the center of the hopper. However, it is troublesome to position the dragline and the hopper as by using a measuring tape each time the dragline and/or hopper are displaced. This problem may advantageously be solved by using an optical distance measuring equipment such as a stadia telescope or an ordinary distance measuring instrument. Taking into account the fact that the boom is about 50 to 100 m in length, it will be sufficient if the accuracy of the measurement is 1/100 to 1/200 or better in which case the error will be less than 50 cm.

Figure 4:
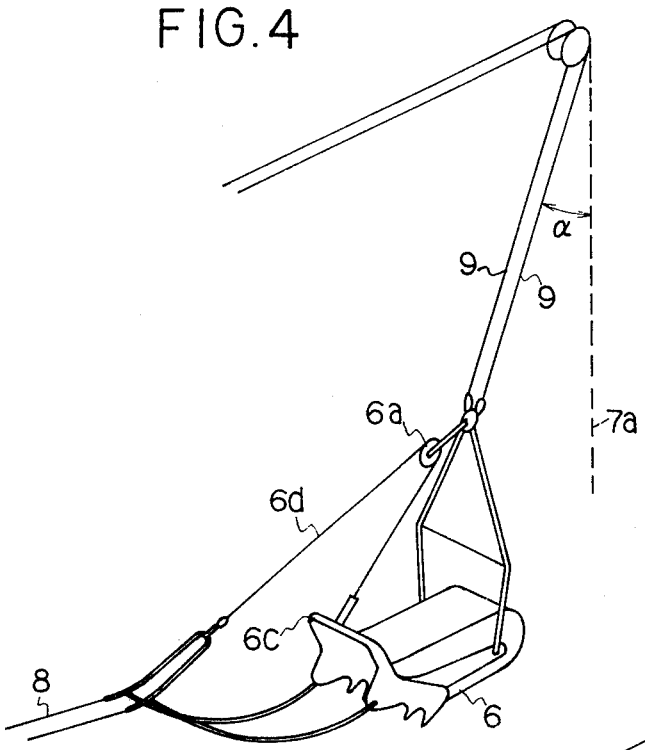
FIGS. 4 is a perspective view illustrating the conventional operation of the bucket of the dragline.

For the positioning procedure it is required only initially to move the dragline in an actual trial so that the forward end 5 of the boom is positioned just above the center 14*a* of the hopper. Once the boom end has been aligned with the hopper center, the optical distance measuring instrument 11 is maneuvered at the cab of the dragline to be pointed at the center 14*a* of the hopper and fixed in place with respect to the dragline, and the distance is read from the instrument. The distance thus read is defined as r'. Once this setting has been established, the operator can measure the distance from the dragline to the center of the hopper by the optical distance measuring instrument as the dragline or the hopper is moved around, and if the distance is equal to r', it means that the central axis 3 of the revolving frame 2 lies on an arc with a radius r' about the center 14*a* of the hopper. The operator can thus make the positioning operation by himself. Although the positioning procedure has been described in a more or less typified manner for the benefit of simplicity, in practice the bucket 6 is offset inwardly toward the dragline body as shown in FIG. 4 rather than lying right below the head sheave 7 during the dumping action. However, it is only required to make the initial positioning operation, and subsequent distance measurements may be made with the bucket 6 in alignment with the center of the hopper.

The method of controlling the movement of the bucket will now be described. The bucket of the properly positioned dragline is moved around over the entire working face 12 during the digging operation. But, the dumping position of the bucket is fixed in both a horizontal and vertical plane. Accordingly, it is possible to insure the positive dumping motion of the bucket over a narrow hopper as well as to substantially reduce the cycle time of the dragline by automatically controlling the movement of the bucket between at least the completion of the scraping action and the dumping action. As a method of accomplishing the automatic control it is conceivable to install a photoelectric tube or radio beacon on or adjacent the hopper so as to detect the proximity of the bucket or boom and feed a signal back to the dragline for controlling. However, such method involves some unreliability due to external disturbances. In addition it is unsatisfactory from a view-point of installation cost and maintenance services in that it requires either a communication cable or signal generator for transmitting detected signals to the dragline which is a mobile machine.

One of the most preferable methods is to accomplish the automatic control on the basis of the number of residual pulses adapted to be produced in direct proportion in number to the number of revolutions of the associated drive shafts of the revolving frame, drag rope drum and hoist rope drum, said pulses having positive and negative signs depending on the direction of rotation of the associated drive shafts.

The automatic control according to the invention will be described in details as follows:

(1) Control of the rotation of the revolving frame (hence the boom):

A pulse signal generator is installed on the drive shaft of a drive motor for rotatively driving the revolving frame or on the transmission between said drive shaft and the driven revolving frame, said signal generator being arranged to produce pulses proportional to the number of revolutions and having positive and negative signs depending on the direction of rotation and to provide the pulse signals to a pulse memory where the positive and negative signals cancel each other. Positive and negative signs of pulses may be discriminated either by the pulse shape or by discriminating the direction of rotation of the electric motor.

Figure 5A:
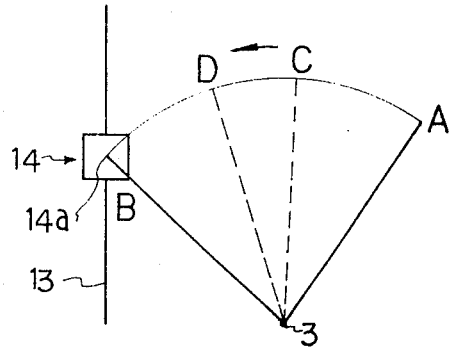
FIG. 5*a* and 5*b* are schematic views showing sequential steps of operation of the walking dragline according to the invention.
Figure 5B:
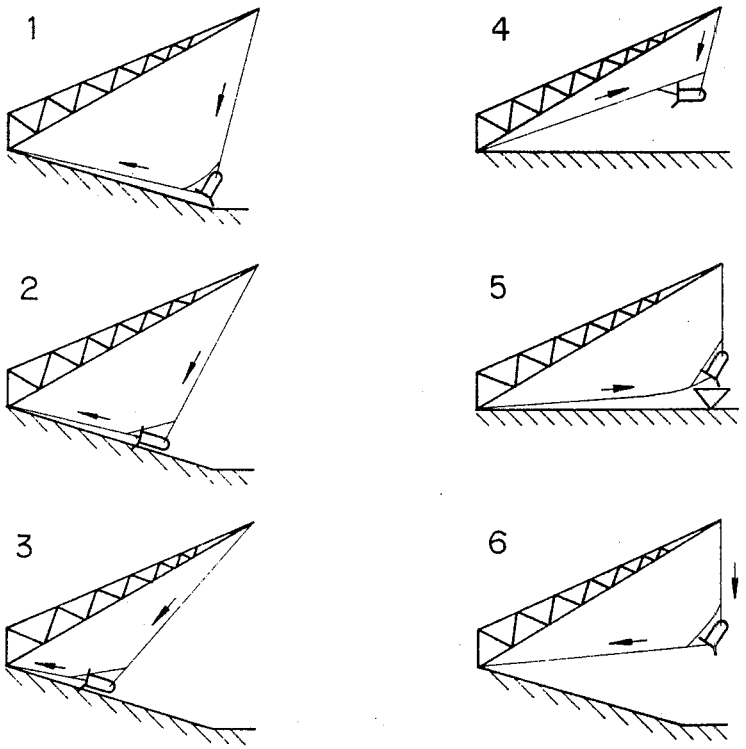
Figure 7A:
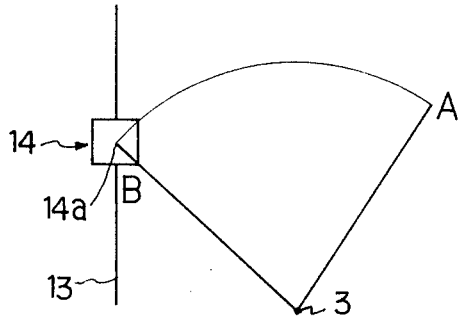
FIGS. 7*a* and 7*b* are schematic views showing sequential steps of operation of the walking dragline equipped with an auxiliary rope according to the invention.
Figure 7B:
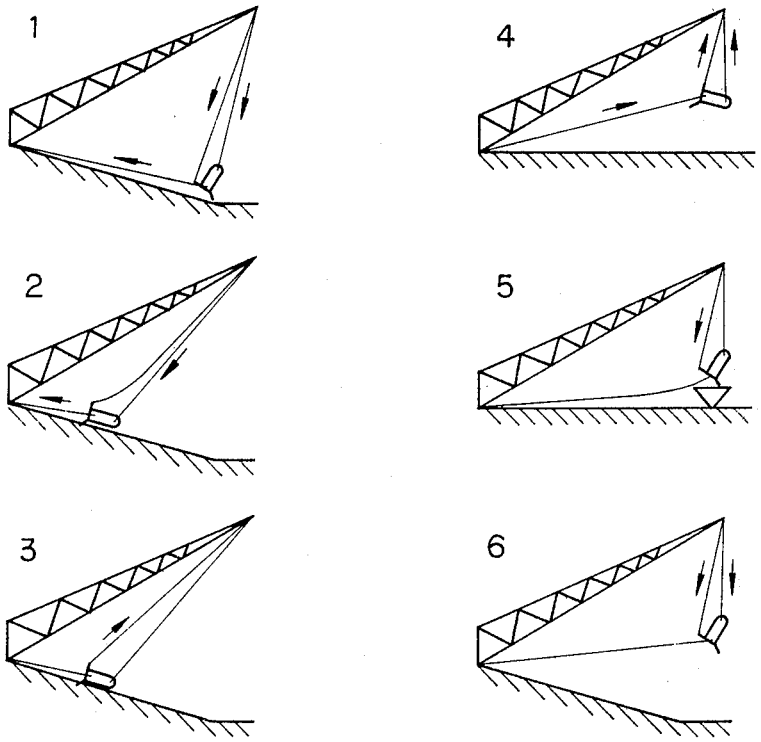

In operation of the dragline the orientation of the boom is preliminarily aligned with a reference line extending between the central axis 3 of the revolving frame and the center 14*a* of the hopper and the pulse memory is reset at zero to eliminate any residual pulses, so that the angle formed between the orientation of the boom and the reference line (as will hereinafter be referred to as horizontal angle of the boom) is directly proportional to the number of residual pulses in the memory with the angle and the number corresponding with each other at 1 to 1. After the scraping action by the bucket is completed, the acceleration, constant speed movement and deceleration of the revolving frame are successively effected by the automatic controlling according to the number of residual pulses corresponding to the preset horizontal angle of the boom. The control operations are preliminarily programmed in a computer on the basis of calculations and actual experiments so that a maximum efficiency in operation may be obtained. The machine is operated in accordance with the instructions from the computer. In FIG. 5*a*, by way of example, the automatic control is initiated at the digging point (A) whereupon the revolving frame is increasingly accelerated in its swinging movement into the constant speed travel at point (C), and then is decelerated at point (D) until it is brought to a halt at point (B). These controls are effected by means of the computer according to the numbers of residual pulses (W), (X), (Y) and (Z) corresponding to the positions (A), (C), (D) and (B), respectively of the boom. The return travel of the empty bucket is usually manually controlled because the digging point (A is changed from time to time. In some instances, however, an initial portion (fixed portion) of the return travel or swing may be incorporated in the automatic control. (2) Control of the drag rope and hoist rope:

As with the control of the rotation of the revolving frame, a pulse signal generator is installed on each of the drag rope and hoist rope drums, said generator being adapted to produce pulses proportional in number to the number of revolutions and having positive and negative signs depending on the direction of rotation so that the pay-out (release) and wind-up (pull) of the associated rope may be automatically controlled according to the number of residual pulses which number corresponds with the length of the released rope at 1 to 1. (However, the relation between the number of pulses and the paid out length of the rope is not necessarily proportional in the case of a drum having more than two plies of rope wound thereon in which one turn of rope in the inner ply is shorter than one turn of rope in the outer ply.) For example, in FIG. 5*b* the material is scraped into the bucket by manual control in steps 1 to 3, thereupon the automatic control is initiated whereby the drag rope is released while the hoist rope is wound up until the hoist rope is shortened to the length suitable for dumping (in step 4). At this point both of the ropes are stopped, and then in step 5 when the bucket is positioned right over the hopper, only the drag rope is paid out to dump the material. It should be noted that the instructions to stop the two ropes in step 4 are issued according to the number of residual pulses corresponding to the paid out lengths of the two ropes whereas the instructions to release the drag rope in step 5 are issued according to the number of residual pulses of the revolving frame corresponding to the horizontal angle of the boom when the bucket is brought to a position just above the hopper. Upon completion of dumping, the return step 6 is performed by manual control back to the digging step 1. It is because the digging point is changed from time to time over the working face that the return and digging steps are manually controlled. The point at which the mode of control is switched from manual to automatic (in other words the paid out lengths of the drag and hoist ropes when the operation is switched from digging to transportation) is not constant for each cycle, either. For example, sometimes it may be in the condition as shown in step 2 and sometimes in the condition shown in step 3. However, even though there is a variation in the point at which the automatic control is initiated, it is possible to make the automatic control by a single program since the rope motions after the automatic control has been initiated are fixed in that the drag rope is moved in the sense to be released while the hoist rope is moved in the sense to be pulled. Further, if there are irregularities on the terrain, the height from the hopper to the forward end of the boom may vary as the dragline is moved. To cope with such situation, the level or elevation of the bucket, hence the paid out lengths of the two ropes just prior to the dumping action are determined by an actual measurement each time the dragline is moved, and the number of residual pulses corresponding to said paid out lengths are cleared to reset the memory at zero whereby the automatic control may be performed by a single program.

As stated above, only one program is usually required. But when there are substantial changes in the working conditions, more than two programs suitable to meet expected working conditions may be prepared in advance so that an optimum program may be selected for particular conditions.

Figure 6:
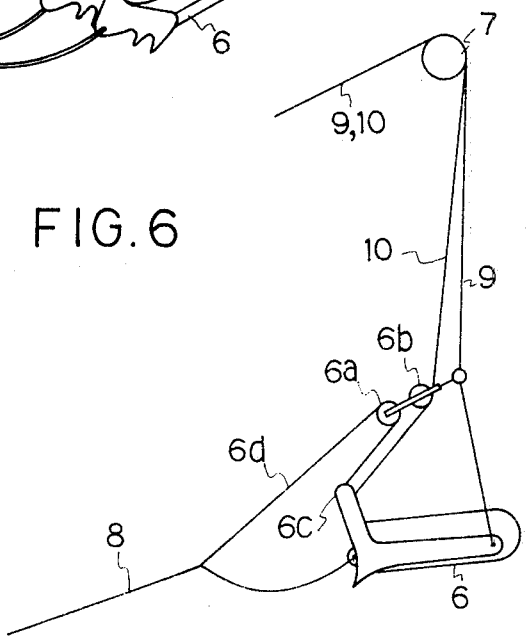
FIG. 6 is a side view showing the operation of a bucket using an auxiliary rope according to the invention.

The method of controlling the bucket utilizing an auxiliary rope will now be described. Although the lateral movement of the bucket during the dumping operation may be substantially perfectly controlled by the automatic control so far described, the control of the forward-rearward or longitudinal oscillation of the bucket is not sufficient. The bucket is designed such that it is maintained in a generally horizontal attitude as well as being prevented from rocking motion by keeping the drag and hoist ropes under tension. An angle X is thus formed between the hoist rope 9 hanging down from the head sheave 7 and the plumb line 7*a* from the head sheave (see FIG. 4). Therefore, if the drag rope 8 is slackened, the bucket is displaced toward the plumb line 7*a* so that the excavated material is dumped over a correspondingly wider area, resulting in requiring a larger hopper. In order to avoid this problem, the present invention employs a third or auxiliary rope in addition to the drag and hoist ropes. More specifically, the auxiliary rope 10 (FIG. 6) extends from a third or auxiliary drum mounted to the revolving frame 2, passes around the head sheave 7 and is connected to the bucket 6 for the purpose of controlling the tilt angle of the bucket as it carries the excavated material. As shown in FIG. 6, preferably the auxiliary rope 10 is connected at one end to the arch 6C of the bucket, passed around an auxiliary pulley 6*b* connected in tandem to a dump rope pulley 6*a*, and trained around the head sheave 7. With this arrangement the bucket is maintained stably in its horizontal attitude during the transfer or transportation, and a smooth dumping action is also insured. The function of the auxiliary rope is to control the tilt angle of the loaded bucket during the transfer and to share the load of the loaded bucket with the hoist rope while maintaining the controlled tilt angle of the bucket until it is unloaded. Accordingly, it is required to change the difference between the paid out lengths of the auxiliary and hoist ropes only when the tilt angle of the bucket is changed. At all other times the two ropes may be moved in unison in their pay-out and wind-up motions. That is, upon completion of the scraping and prior to the transfer of the bucket, the lengths of the two ropes are adjusted to maintain the bucket in its horizontal attitude, and during the dumping action the auxiliary rope alone is released.

As indicated above, since the addition of the auxiliary rope does not make the operation of the dragline so complexed, the manual operation using the auxiliary rope is possible and effective in its own way. But as stated hereinbefore, as the manual operation is inefficient, it is preferable to make the automatic and integrated control of the boom 4, drag rope 8, hoist rope 9 and auxiliary rope 10.

The automatic control of the dragline with the auxiliary rope is described as follows: In FIG. *7a* the boom is moved between the digging position (A) and the hopper position (B). FIG. *7b* illustrates the sequential motions of the three ropes as the boom is moved between the positions (A) and (B). In step 1 the hoist and auxiliary ropes are paid out while the drag rope is wound up to be ready for digging. These ropes continue to be moved in the same directions as the digging work proceeds until it is finished in step 2. During this time the bucket has been rotated nearly 90° from its approximately vertical to horizontal position so that the auxiliary rope has sagged. To eliminate this sag the auxiliary rope alone is wound up in step 3 while the hoist rope is halted. Thereafter, in step 4 the hoist and auxiliary ropes are wound up while the drag rope is paid out to lift the bucket to a level suitable for dumping. At this time the bucket is suspended generally directly below the head sheave because the drag rope is imparted a tension just enough to prevent the rocking motion of the bucket. In this condition the boom continues to be rotated to bring the bucket to a position right above the hopper whereupon in step 5 the auxiliary rope is released and the drag rope is slackened to unload the bucket. Thereafter, the bucket is lowered through a manual control in step 6 and back to step 1 for digging. All the foregoing motions of the ropes are controlled by the number of residual pulses corresponding to the paid out length of the respective ropes, except that the instructions as to the motion of the ropes during the dumping action in step 5 are issued according to the number of residual pulses of the revolving frame.

One technical difficulty attendant to the operation employing an auxiliary rope is how to balance the hoist and auxiliary ropes. The hoist and auxiliary ropes suspending the bucket at opposite ends are substantially independent of each other in contrast to the drag and hoist ropes which are in pulling and constraining relation with each other. It is quite difficult to accomplish such a delicate control as to drive two independent ropes separately by two motors and yet maintain the bucket in a horizontal attitude.

To solve this problem the inventors have developed a method of driving the two ropes by a single motor by analyzing the motions of the hoist and auxilliary ropes. The sequential motions of the ropes as shown in FIGS. *7a* and *7b* are summarized in Table I for the benefit of clarity. Comparison between the motions of the hoist and auxiliary ropes in Table I shows that through the manual and automatic portions of control both of the two ropes move in the same manner (steps 1, 2, 4 and 6) or otherwise the auxiliary rope alone moves while the hoist rope remains stationary (steps 3 and 5). Accordingly, a single prime mover may be provided to drive the two ropes. Preferably, the prime mover is connected directly to the drum of the auxiliary rope which does not stop at any point of time, and said drum is connected through a clutch to the drum of the hoist rope. Of course, this driving system would have no trouble in stopping both of the drums.

| Steps | Positions of boom | Conditions of ropes: hoist rope | auxiliary rope | drag rope | Operation of dragline | modes of control |
|---|---|---|---|---|---|---|
| 1 | A | pay-out | pay-out | wind-up | preparatory to scraping | manual |
| 2 | A | idle | idle | wind-up | scraping | manual |
| 3 | A | halt | wind-up | halt | preparatory to transfer of loaded bucket | automatic |
| 4 | A→B | wind-up | wind-up | pay-out | transfer of loaded bucket | automatic |
| 5 | B | halt | pay-out | idle | dumping | automatic |
| 6 | B→A | pay-out | pay-out | idle | return of empty bucket | manual |

Figure 8:
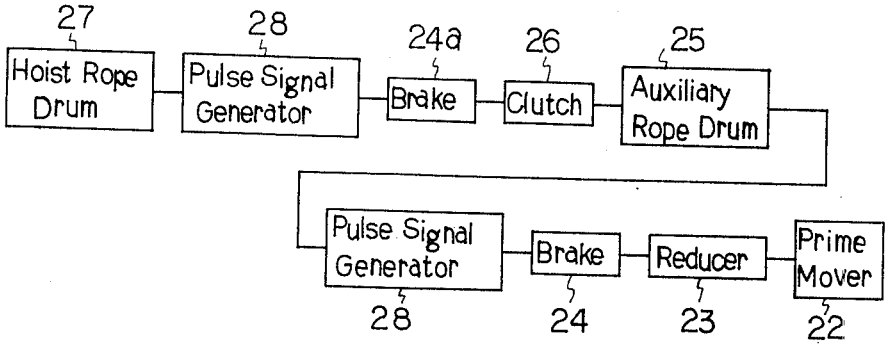
FIG. 8 is a schematic view showing the operational principle on which the dragline with an auxiliary rope according to the invention is driven.

FIG. 8 schematically illustrates the principle on which the drive system of the invention operates. At the right side of FIG. 8 there is shown a prime mover 22 to which an auxiliary rope drum 25 is coaxially connected through a reducer 23 and a brake 24. A hoist rope drum 27 is connected to the auxiliary rope drum through a clutch 26 and a brake 24*a*. The two drums have pulse signal generators 28, 28 associated with their respective shafts. Considering this drive system with reference to Table I, the clutch 26 is actuated in steps 1 and 2 to rotate both drums in the release direction and then bring them into an idle condition. In step 3 after both drums have stopped the clutch 26 is disengaged, and the auxiliary rope drum 25 alone is rotated in the pull direction. In step 4 the brake 24*a* of the hoist rope drum is released and the clutch is engaged to rotate the hoist rope drum 27 along with the auxiliary rope drum 25. In step 5 after both drums have stopped, the clutch is disengaged and the auxiliary rope drum alone is rotated in the pay-out or release direction. In step 6 the clutch 26 is again engaged to rotate both drums in unison in the release direction. In this manner the hoist and auxiliary ropes can be operated very smoothly. The drive system as described just above using a single prime mover may be equally applicable to the manually controlled operation.

Here attention is directed to the meaning of the term "auxiliary rope" as herein used. Most heavy-duty draglines employ a dual-rope suspension system for the hoist rope means (also for the drag rope means) comprising two drums, two head sheaves and two ropes. In such instance the auxiliary rope system according to the invention may be adopted simply by adapting one of the dual hoist ropes for the auxiliary rope without the need for providing an additional single or dual-rope type auxiliary rope means, because the load of the bucket is shared by the hoist and auxiliary ropes just as it is by the dual hoist ropes. Accordingly, no additional drum or head sheave for the auxiliary rope is required except that the connection of one of the dual suspension ropes to the bucket and the driving connection of the two drums need be modified.

The use of the automatic control according to the invention enables a reduction in size of the hopper for receiving the excavated material from the bucket. The planar dimensions of the hopper may preferably be such that one side of the hopper is 1.0 to 2.5 times as long as the length of the bucket. With less than 1.0 times, the dumped material can spill out the bucket, and with greater than 2.5 times, it becomes difficult to displace the hopper. More specifically, for the automatic control using the auxiliary rope it is particularly preferable that the size of the hopper be such that one side thereof is 1.2 to 1.5 times as long as the bucket. For the automatic control without the auxiliary rope, the hopper is very preferably sized such that the length one side thereof is 1.5 to 2.0 times that of the bucket.

The method of disposing of large lumps contained in the material dug will be described. Large lumps in the excavated material are separated by an inclined sieve means disposed over the hopper body to prevent them from falling into the hopper. When large masses of rock or stone in the excavated material are in a relatively small amount, the separated large masses are put aside on the ground, and as a certain amount of masses is piled up, they may be loaded on trucks as by front-end loaders and carried out of the working area. Turning back to FIG. 2, there is shown a method of processing large lumps in a more efficient manner in the case a great quantity of coarse masses is contained in the material dug. Large lumps are deposited on the coarse mass belt conveyor positioned adjacent the discharge end of the inclined sieve 15, broken to pieces of an appropriate size, by a crusher 19 and withdrawn by a haul-off conveyor 20. The broken fragments are then dropped through a chute 21 back onto the belt conveyor 13 extending below the hopper to be carried away together with those fine particles of the exacavated material passed through the sieve. One form of large lump conveyor is known in which the frame is equipped with shock absorbing springs. A large-sized double chain conveyor may also be used.

While any type of known crusher may be utilized for this purpose, a jaw crusher which is suited to process large masses and which may be made compact in size is especially desirable in the case it is not required to break the lumps to very fine pieces. For the haul-off conveyor, any ordinary belt conveyor or double chain conveyor may be employed.

All of said large lump conveyor 18, crusher 19 and haul-off conveyor 20 may either be mounted on a wheeled platform or may have their legs provided with boat-shaped shoes or wheels like the hopper as will be hereinafter described, whereby they may be movable along the belt conveyor 13. These components may be moved by towing them by heavy-duty machines such as a heavy-duty bulldozer, loader or the like. In some instances they may be pulled by a dragline.

Figure 9:
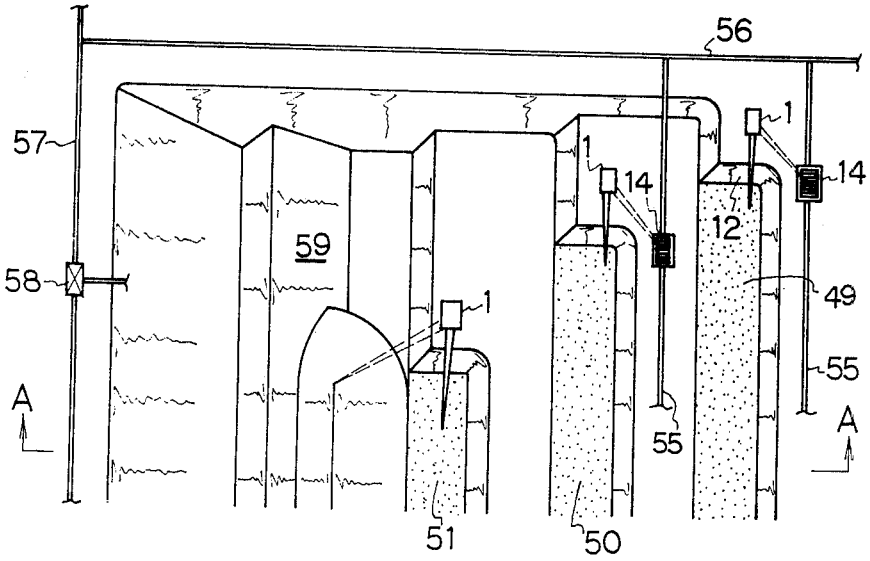
FIG. 9 is a plan view illustrating the method according to the invention of digging the overburden of each of three coal seams in a three-strata coal mine.
Figure 10:
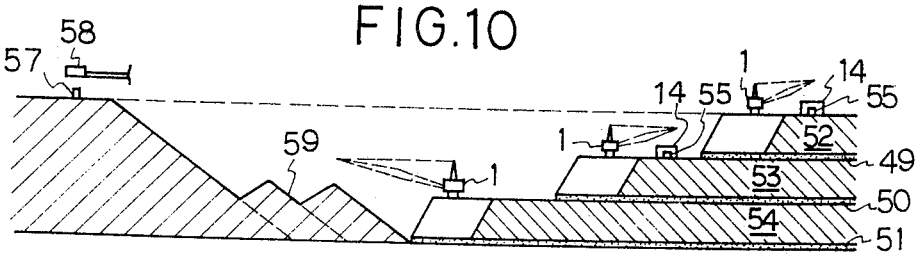
FIG. 10 is a sectional view taken on the line A—A of FIG. 9.

The method of applying the foregoing process of digging by the combination of a dragline and belt conveyor to the mining of multiple-strata coal mine wll next be described. This invention provides a method comprising the steps of digging an overburden or an upper layer of earth overlying the lowermost coal seam by a dragline and depositing the excavated material directly on the gob area of said lowermost coal seam; and digging overburdens of coal seams above the lowermost coal seam by respective draglines and loading and transporting the excavated material on belt conveyor means laid parallel to the associated zones of the mining area by means of hoppers movable along the associated belt conveyors. This method will be fully explained with reference to the drawings. FIG. 9 is a plan view of a stope in which three-strata coal seams are simultaneously mined. FIG. 10 is a sectional view taken on the line (A)—(A) in FIG. 9. The coal seams are called first, second and third coal seams 49, 50 and 51 in the order from the top downward, and the earth layers overlying the respective coal seams are called first, second and third overburdens 52, 53 and 54. The stratum comprising the first coal seam and first overburden is referred to as first stratum. The two similar lower strata are termed second and third strata. A dragline 1, face conveyor 55 and hopper 14 are installed on each of the first and second strata. Extending along the outer boundary of the mining area is an intermediate conveyor 56 which is disposed generally at right angles to the face conveyors and into which the face conveyors discharge. Further, a gob conveyor 57 is laid at the gob or waste area to receive the discharge from the intermediate conveyor and is arranged to discharge into a stacker 58 for spreading the excavated material over the gob or waste area 59 from which the coal has already been extracted. On the third overburden a dragline 1 only is installed. In general, shiftable belt conveyors are preferably used for the face conveyor 55 and gob conveyor 57 while the intermediate conveyor 56 may preferably be a fixed conveyor. Further, when a relatively large proportion of big lumps is contained in the material dug, a large lumps conveyor 18, crusher 19, haul-off conveyor 20 and chute 21 may advantageously be used in conjunction with the hopper 14 as described above in connection with the arrangement of FIG. 2.

The digging is carried out successively with the first, second and third strata in the order named. The digging of each stratum proceeds from the starting point (not shown) toward the intermediate conveyor 56 along the face conveyor 55 usually with a cutting width of 30 to 50 m. First, uppermost or first overburden 52 is broken to fragments by blasting and dug by the dragline 1 in the same manner as described hereinabove in connection with FIG. 1. The excavated material is then loaded through the hopper 14 onto the face conveyor 55 which discharges into the intermediate conveyor 56. The excavated material is then discharged into the gob conveyor 57 and ultimately dumped through the stacker 58 behind the mining area. Upon completion of the digging within the limits from which dragline 1 can reach the hopper 14, the dragline and hopper are moved to continue with the digging of the first stratum 52 in the same manners. When an appropriate length (usually 100 to 200 m) of the first coal seam 49 immediately below the first overburden 52 has been exposed, the mining of the first coal seam is initiated from the remote end thereof to proceed toward the working face 12 of the first overburden. The coal mining may be effected by any conventional mining method using explosives, power shovels, trucks (any of them not shown), etc. As the excavating operation has proceeded to the terminal edge of the mining area adjacent the intermediate conveyor), the equipment including the face conveyor 55, hopper 14 and dragline 1 are transferred to the adjacent second zone of the first or uppermost stratum to dig the second cutting zone from the starting end towards the intermediate conveyor in the same manner. In this way the first stratum continues to be dug one zone after another.

Upon the digging and mining of the first stratum having thus proceeded to a certain extent, the digging of the second stratum is initiated with a space of one or two cutting widths from that zone of the first stratum in process of digging. The spacing of one or two cutting widths insures a space for laying a face conveyor for the second overburden digging as well as isolating the second stratum from the influence of blasting in the first stratum. The digging of the second stratum is effected in the same way as the first stratum. Upon digging of the second stratum having proceeded for a few cutting zones, the digging of the third stratum is started. The third overburden is first excavated. In this case, however, it should be noted that the excavated material is dumped over the gob area 59 directly by the dragline 1 without using a face conveyor. The other operations are the same as the digging of the first and second strata.

The excavations of the first, second and third strata thus proceed such that each succeeding stratum follows the immediately preceding one. The excavated material from the third overburden is piled on the waste area of the third stratum to fill it in the wake of the progressively worked third stratum. The excavated materials from the first and second overburdens are piled successively on the excavated material of the third overburden previously dumped on the waste area. Accordingly, as the digging of the various strata proceeds, the gob conveyor 57 is transferred progressively forward. The entire mining area is thus a system moving parallel in an orderly manner which provides a very high efficiency in operation with shortened distances of travel through which the excavated material is transported and a minimum working space required for the mining operations.

It is to be appreciated that the foregoing mining method according to this invention using draglines jointly with belt conveyors enables the mining of multiple-stratified coal seams which has heretofore been impossible with the prior art method using draglines alone.

The present invention is not limited to the embodiments herein illustrated but may be practiced in many different forms without departing from the spirit and scope of the invention. By way of example, even in the case of a single stratum coal seam, if the overburden above the coal seam is so thick as to exceed the working capacity, the digging of the overburden may be effected efficiently by dividing the overburden into an appropriate number of layers so that those layers may be worked by the multiple-strata digging method of this invention. Since the efficiency of the strip mining depends for the most part upon the efficiency of mining of overburden, the industrial value of this invention is considered extremely high.

FIGS. 11 to 16 illustrate preferred forms of the haulage or transport apparatus according to the invention. Throughout these drawings like component parts are designated by like reference numerals.

Figure 11:
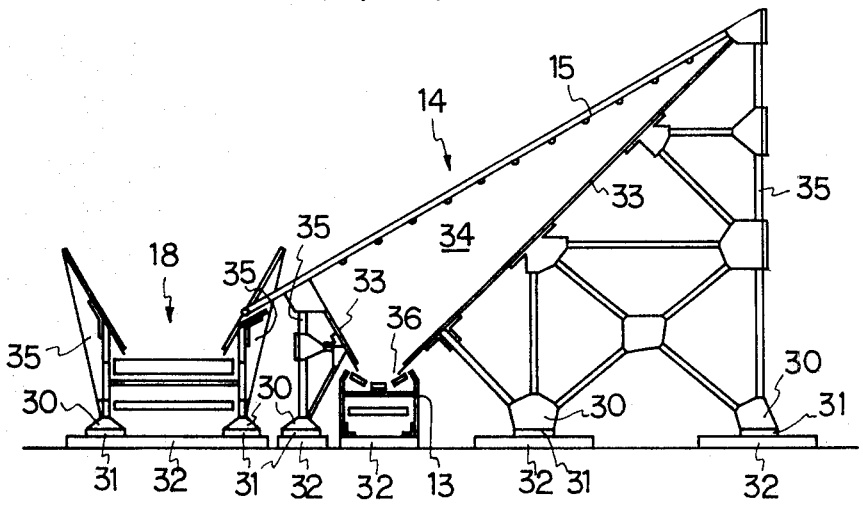
FIGS. 11 to 14 are side elevations, partly in section of various forms of hopper means according to the invention.

Referring to FIG. 11, there is shown a hopper body 34 straddling the belt conveyor 13, the hopper body including a pair of opposed side walls 33, 33 extending parallel to the longitudinal axis of the belt conveyor 13 and sloping downwardly inwardly toward the conveyor to form therebetween a discharge opening through which the excavated material is deposited onto the conveyor 13. A pair of opposed end walls (not shown) of the hopper body 34 extending transversely to the belt conveyor 13 may preferably be disposed generally vertically in order to provide an increased area of the discharge opening and facilitate smooth dropping of the material along those hopper walls, although the end walls may be inclined with respect to the vertical plane transverse to the conveyor, if desired.

One of the opposed wide walls 33, 33 is made higher than the other to define an enlarged mouth opening for loading the material dug. Extending across the mouth opening is an inclined sieve means 15. Material dug is dumped over the sieve means 15 by the bucket 6 of the dragline 1 (FIG. 6) and finer particles passing through the sieve are loaded onto the belt conveyor 13 to be hauled to an appropriate place (not shown).

Installed juxtaposition the hopper body 34 is a large lump belt conveyor 18 which is adapted to receive and haul the large lumps of soil and rock separated by the inclined sieve means 15.

The side walls 33, 33 of the hopper body are mounted to supporting framework 35 on the bases 30 of which are mounted boat-shaped shoes 31 which ride slidably on sleepers 32. The large lump belt conveyor 18 is constructed in a similar manner.

Figure 12:
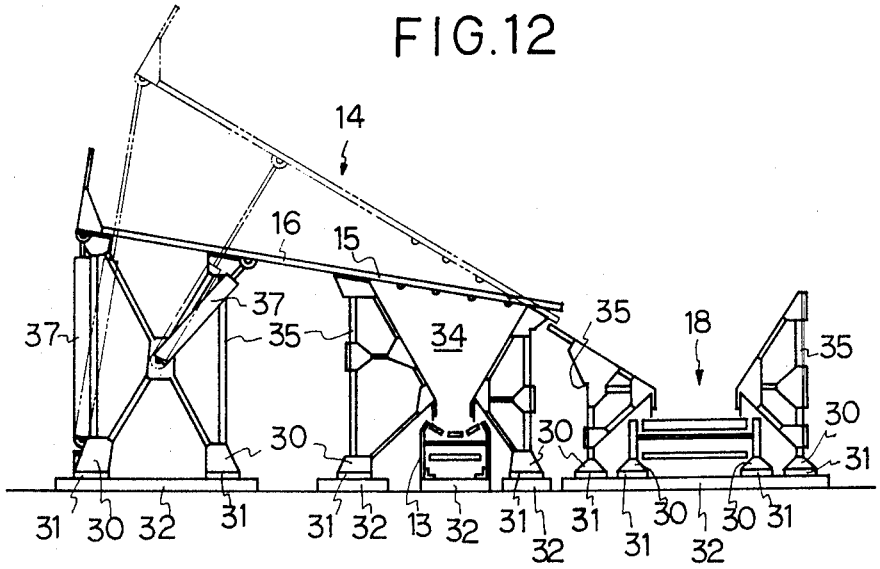

FIG. 12 shows another embodiment of the hopper means in which the hopper body 34 has a reduced top opening, hence a reduced hopper capacity and a small inclined sieve 15. In this embodiment, however, an inclined material receiving plate 16 is integrally and coextensively joined to the upper side edge of the sieve 15. This hopper means is characterized in that the unitary inclined sieve 15 and inclined receiving plate 16 is connected to the framework 35 by means of fluid operated piston-cylinders 37 so that the sieve and plate unit may be adjusted in its tilt angle by actuating the piston-cylinders. In operation, with the piston-cylinders 37 retracted to hold the sieve and plate unit at a gentle angle, the hopper receives the material dug from the dragline bucket. After some of the relatively fine particles of the material which passed through the sieve portion 15 and fell into the hopper body 34 have been carried away, the piston-cylinders are extended to tilt the unit of sieve 15 and plate 16 to a steeper angle as shown in dash-dot lines in FIG. 12. With this arrangement, some of the material dumped from the bucket is temporarily accumulated on the inclined receiving plate 16, enabling reduction in capacity of the hopper body 34. In addition, large lumps slide down the inclined sieve 15 after they have once come to rest, so that damages to the large lump conveyor 18 may be greatly relieved as compared with the arrangement wherein the excavated material are dumped from the bucket at a high elevation with accelerated velocity onto the inclined sieve and immediately slide down the sieve. Since the energy of collision of the large masses of soil and rock is proportional to the square of the velocity of collision, a great effect is obtained by reducing the velocity of the sliding down masses. As a result, the large lump conveyor 18 may require less structural strength and be made lighter in weight. Another advantage of this form of hopper means is that it is relatively low in height and dividable into three parts—the body portion, piston-cylinders and inclined sieve portion to thereby greatly facilitate the movement of the hopper.

Figure 13:
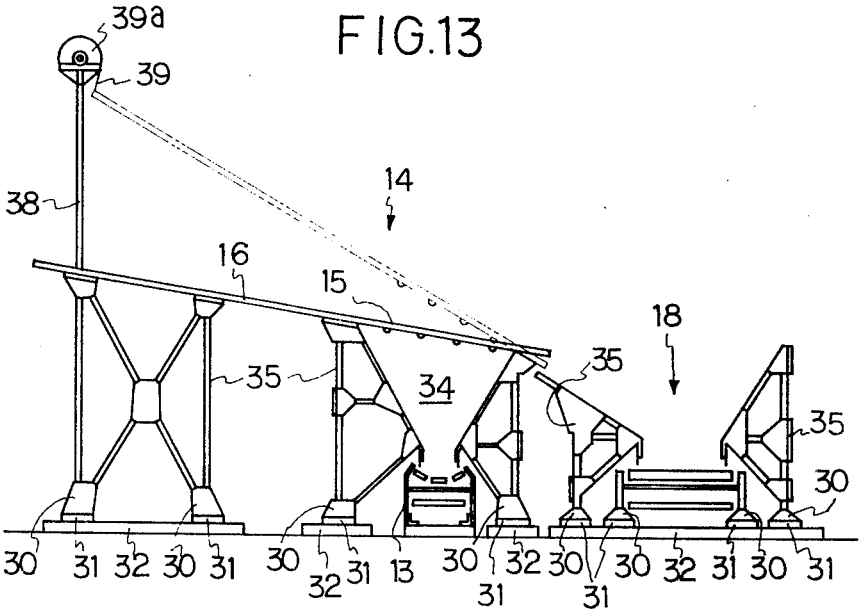

FIG. 13 shows a still another form of the hopper in which the hydraulic cylinder means as used in the embodiment of FIG. 12, as an elevator for lifting the inclined sieve 15 and receiving plate 16 is substituted for by a less expensive hoist means comprising a hoist motor and drum (not shown), a post 38, rope 39, and sheave 39*a*. In this case, the hoist means may be installed on the large lump conveyor side, instead of the side of the belt conveyor 13 opposite from the large lump conveyor. The dash-dot lines in FIG. 13 shows the inclined unit of sieve and receiving plate in its lifted position.

Figure 14:
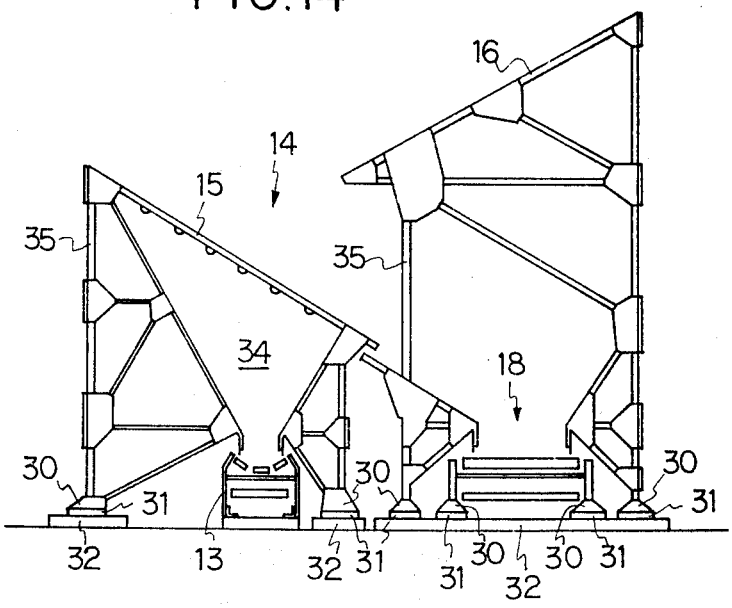

FIG. 14 shows an alternate form of the hopper in which the inclined receiving plate 16 is separate from the inclined sieve 15 and supported at a higher elevation than the sieve by a supporting framework 35 separate from the framework of the hopper body 34. Further, the receiving plate is inclined in a direction opposite the direction of inclination of the sieve. This hopper has characteristic features intermediate between the embodiment of FIG. 11 and the embodiments of FIGS. 12 and 13. Thus, large masses drop onto and slide down the inclined receiving plate 16, hit the inclined sieve 15, change their direction and slide down the sieve onto the large lump conveyor 18 with reduced shock against the conveyor. Further, the framework is divided into two sections for the hopper body and the receiving plate so that it is convenient for shifting. Another advantage of this embodiment is that since the large lump conveyor 18 is sheltered by the receiving plate 16, there is little possibility of the material dug dropping and damaging the conveyor 18 as during a trial bucket operation.

Figure 15:
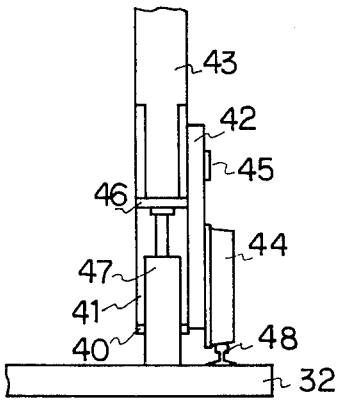
FIG. 15 is a front view of a wheel mounted on a supporting frame of the hopper.
Figure 16:
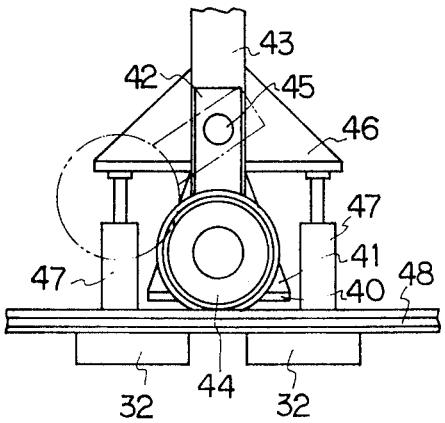
FIG. 16 is a side view of the wheel in FIG. 15.

The supporting frameworks in the embodiments of FIGS. 11 to 14 are all provided on their bases or feet with boat-shaped shoes 31 which are adapted to ride on the sleepers 32 as means for moving or shifting the entire hopper. However, when such hopper means is large-sized and heavy, it is not easy to transport. While it is preferable from a viewpoint of transportation that the hoppe framework be wheel-mounted to ride along rails, the wheel-mounting is not desirable because during the operation the hopper is subjected to impact load by large masses as dumped from the dragline bucket, in addition to the static load. To overcome this problem, the present invention provides framework bases which are adapted to be supported by fixing legs during the operation and which are supported on wheels during the transportation of the hopper. An embodiment incorporating such bases is illustrated in FIGS. 15 and 16. As shown, the lower portions of the leg posts 43 only one of which is shown constitute fixing legs 41 downwardly spread out to form bottom tread faces 40. A support arm 42 having a wheel 44 attached to one end thereof is pivotally mounted at the other end to each of the leg posts 43 above the fixing leg 41 by a pivot shaft 45. Each leg post 43 has jack supports 46 extending from its opposed sides, each of the jack supports having a jack 47 secured to its bottom. During the operation of the hopper, the wheels 44 are pivoted upward away from the associated rails 48 as shown in dash-dot lines in FIG. 16 and the jacks 47 are retracted to cause the tread faces 40 of the fixing legs 40 to rest on the sleepers 32 to thereby support the hopper on the fixing legs 41. To move or transport the hopper the jacks 47 are extended to lift the tread faces 40 of the fixing legs 41. The wheels 44 are then lowered over the rails 48 and the jacks 47 are retracted to engage the wheels with the rails. After the hopper has been pulled to a desired location by a heavy-duty machine (not shown), the jacks 47 are extended to lift the wheels 44 from the rails to permit the pivoting of the wheels upward, and then the jacks 44 are retracted to lower the fixing legs 41 into engagement with the sleepers 32. It is to be appreciated that this base support arrangement not only facilitates the movement of even large-sized heavy hoppers but also provides security against impact loads during the dumping of the material.

This arrangement is also applicable to the large lump conveyor, crusher and haul-off crusher described hereinabove.

While the present invention has been described with reference to the preferred embodiments, it is not limited to those embodiments, but it will be apparent to those skilled in the art that the invention may be practised without departing from the spirit and scope of the invention.

What is claimed is:

1. A method of digging and transporting soil and sand, rocks and stones, minerals or the like by the use of a dragline including a bucket means for digging and carrying said soil, rocks, minerals, or the like, a boom means suspended for swinging movement therewith, a bucket control means for controlling said bucket means, and a boom control means for controlling the swinging movement of said boom means, said method comprising the steps of:

(a) fixing a first hopper means at a predetermined location straddling a first conveyor means for transporting the material dug, said hopper means being shiftable along the conveyor means and adapted to receive the dug material as carried in the bucket means by said dragline and load the material onto the conveyor means;

(b) positioning said dragline at such a location that the dug material in the bucket means may be dumped from right above said hopper means;

(c) digging soil, rock, minerals, or the like and loading the material dug onto said hopper means by operating said bucket control means and boom control means at said location, and performing such digging and loading operations in a like manner with said boom means positioned at its various swing positions, as required;

(d) thereafter shifting said hopper means by a certain distance along said conveyor means and fixing it in place;

(e) carrying out the step (b) and (c);

(f) repeating the steps (d) and (e), as required;

(g) installing a second hopper means and a second conveyor means generally parallel to and with a predetermined spacing away from said first hopper means and first conveyor means on the dug surface which has been worked by the first dragline in conjunction with the first hopper and conveyor means;

(h) positioning a second dragline at such a location that the dug material loaded in the bucket means of said second dragline may be dumped from right above said second hopper means;

(i) performing said steps (c) to (f); and (j) successively digging the preceding dug surface n like manner, as required, the improvement wherein the digging operation is performed using a plurality of draglines, hopper means and conveyor means and wherein the material dug by the dragline installed on the lowermost dug surface is dumped from said dragline directly over the already worked site of the lowermost dug surface rather than being carried away from the working area, the material dug from one or more dug surfaces higher than the lowermost dug surface by the associated draglines and hauled by the associated conveyor means is collected into a separate conveyor means, the site worked by said dragline installed on the lowermost dug surface is filled up with said collected dug material.

2. A method according to claim 1 wherein in said step (c) said bucket control means and boom control means are operated so as to lift up said bucket means after it has scraped soil, rock, minerals or the like therein, swing said boom means to a position right above said hopper means, and dump the material from the bucket means, said bucket control means including a first hoist rope passing over a first head sheave mounted to said boom means adjacent the forward end thereof and suspending said bucket means, a drag rope for pulling said bucket means toward the main body of the dragline to scrape the soil, rock, minerals or the like into the bucket means, a first hoist rope drum means for selectively winding up and paying out the first hoist rope, and a drag rope drum means for selectively winding up and paying out the drag rope, said boom control means including a boom drive means for swinging said boom means, each of said first hoist rope drum means, said drag rope drum means and said boom drive means having a pulse signal generator installed on its drive shaft, each of said pulse signal generators being adapted to produce pulses proportional in number to the number of revolutions of its associated drive shaft and having positive and negative signs depending upon the direction of rotation of the shaft whereby said bucket control means and boom control means may be automatically controlled according to the number of residual ones of pulses produced.

3. A method according to claim 1 wherein in said step (c) said bucket control means and boom control means are operated so as to lift up said bucket means after it has scraped soil, rock, minerals or the like therein, swing said boom means to a position right above said hopper means, and dump the material from the bucket means, said bucket control means including a first joist rope passing over a first head sheave mounted to said boom means adjacent the forward end thereof and suspending said bucket means, a drag rope for pulling said bucket means toward the main body of the dragline to scrape the soil, rock, minerals or the like into the bucket means, a first hoist rope drum means for selectively winding up and paying out the first hoist rope, and a drag rope drum means for selectively winding up and paying out the drag rope, said bucket control means further including a second hoist rope passed over a second head sheave mounted to said boom means adjacent the forward end thereof and adapted to control the tilt angle of the bucket means when it carries the material dug and a second hoist rope drum for selectively winding up and paying out said second hoist rope, said boom control means including a boom drive means for swinging said boom means.

4. A method according to claim 1 wherein said first hoist rope drum means is connected in tandem through a clutch means to said second hoist rope drum means, said first and second hoist rope drum means being connected to a single prime mover.

5. A method according to claim 3 wherein each of said first and second hoist rope drum means, said drag rope drum means and said boom drive means has a pulse signal generator installed on its drive shaft, each of said pulse signal generators being adapted to produce pulses proportional in number to the number of revolutions of its associated drive shaft and having positive and negative signs depending upon the direction of rotation of the shaft whereby said bucket control means and boom control means may be automatically controlled according to the number of residual ones of pulses produced.

6. A method according to claim 1 further including, between said steps (c) and (d), the steps of:

(C-1) moving said dragline to another location on an arc with its center at the center of said hopper means and with a radius equal to the distance between the center of the hopper means and the center of swing of said boom means, after completing the digging operation in said step (c);

(C-2) performing the step (c) at said another location; and (C-3) repeating said steps (C-1) and (C-2).

7. A method according to claim 6 wherein in the step (C-1) said another location to which said dragline is to be moved is determined by means of an optical distance measuring means installed on the dragline.

* * * * *